US011022083B2

(12) United States Patent
Hinten et al.

(10) Patent No.: US 11,022,083 B2
(45) Date of Patent: Jun. 1, 2021

(54) INJECTOR ALIGNMENT APPARATUS AND METHODS OF USE THEREOF

(71) Applicant: HONDA MOTOR CO., LTD., Tokyo (JP)

(72) Inventors: Richard Jay Hinten, Ludlow Falls, OH (US); Brandon David Harvey, Troy, OH (US); Curtis Kremer, Minster, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 66 days.

(21) Appl. No.: 16/254,444

(22) Filed: Jan. 22, 2019

(65) Prior Publication Data

US 2020/0232435 A1 Jul. 23, 2020

(51) Int. Cl.

| | |
|---|---|
| ***F02M 61/16*** | (2006.01) |
| ***F02M 69/46*** | (2006.01) |
| ***F02M 61/14*** | (2006.01) |

(52) U.S. Cl.

CPC ..... *F02M 61/168* (2013.01); *F02M 69/465* (2013.01); *F02M 61/14* (2013.01); *F02M 2200/856* (2013.01)

(58) Field of Classification Search

CPC ..... F02M 61/168; F02M 69/465; F02M 2200/856; F02M 61/14

See application file for complete search history.

(56) References Cited

U.S. PATENT DOCUMENTS

| | | | | |
|---|---|---|---|---|
| 4,685,850 | A | 8/1987 | Ohta et al. | |
| 5,329,803 | A * | 7/1994 | Booth | F02B 77/00 33/607 |
| 5,697,345 | A * | 12/1997 | Center | F02M 61/14 123/470 |
| 7,334,572 | B1 * | 2/2008 | Diggs | F02F 7/006 123/195 C |
| 9,103,416 | B2 | 8/2015 | Tappan | |
| 9,133,799 | B2 | 9/2015 | Takasaki et al. | |
| 9,631,594 | B2 | 4/2017 | Harvey et al. | |
| 2003/0033714 | A1 * | 2/2003 | King | F02M 61/14 29/888.011 |
| 2010/0300408 | A1 * | 12/2010 | Aronhalt | F02M 61/14 123/470 |

(Continued)

FOREIGN PATENT DOCUMENTS

| | | | |
|---|---|---|---|
| CN | 202147118 | U | 2/2012 |
| CN | 105798651 | A | 7/2016 |
| DE | 10 2009 004 773 | A1 | 7/2010 |

*Primary Examiner* — Joseph J Dallo
*Assistant Examiner* — Kurt Philip Liethen
(74) *Attorney, Agent, or Firm* — Arent Fox LLP

(57) ABSTRACT

An apparatus, method, and system for aligning at least one injector body to be installed into an engine block along a first direction. The alignment apparatus includes a first alignment member configured to swing between a clearance position and an alignment position, wherein the first alignment member is configured to align the at least one injector body along a second direction when in the alignment position. The apparatus further includes a second alignment member configured to align the at least one injector body along a third direction by contacting the at least one injector body via a first and second contacting portion.

17 Claims, 14 Drawing Sheets

(56) References Cited

U.S. PATENT DOCUMENTS

| | | | | |
|---|---|---|---|---|
| 2011/0073076 | A1* | 3/2011 | Lazich | F02M 61/14 123/470 |
| 2011/0232608 | A1* | 9/2011 | Ramamurthy | F02M 61/14 123/470 |
| 2019/0170101 | A1* | 6/2019 | Pasquali | F02M 61/168 |

* cited by examiner

INJECTOR ALIGNMENT APPARATUS AND METHODS OF USE THEREOF

FIELD OF THE INVENTION

Aspects of the present disclosure relate to an apparatus and method for aligning an injector or series of injectors, and more specifically, an apparatus and method for aligning a series of injectors for installation into a receiving portion of an internal combustion engine.

BACKGROUND

Fuel injectors or fuel rail assemblies for use in both port injection and direct injection engines often must be aligned during either a fully automated or semi-automated engine assembly process. Frequently, fuel injectors or fuel rail assemblies are provided with mounting points that allow installation of the injectors or assemblies with a jig that holds the injectors and/or fuel rail assembly in a fixed position along a single or multiple axis during installation. However, traditional jig assemblies may not be usable with some injectors and/or fuel rails that are not provided with mounting points or are provided with mounting points that are not practical for use during the installation process using traditional jigs. For example, the location of a jig connected to some mounting points on the injectors and/or fuel rail assembly may cause interference during the assembly process. Thus, an unmet need exists for an alignment apparatus that is usable with injectors and/or fuel rail assemblies that are not practical for use with typical jig assemblies. Further advantages will become apparent from the disclosure provided below.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

In accordance with one aspect of the disclosure, an apparatus is disclosed for aligning at least one injector body to be installed into an engine component along a first direction. The apparatus includes a first alignment member configured to swing between an alignment position and a clearance position, wherein the first alignment member is configured to align the at least one injector body along a second direction when in the alignment position. The apparatus further includes a second alignment member configured to align the at least one injector body along a third direction that is different from the second direction, by contacting the at least one injector body via first and second contacting portions. The second alignment member is configured to contact the injector via the first and second contacting portions while the first alignment member is in the alignment position, and the second alignment member is configured to maintain contact with the at least one injector body while the first alignment member swings from the alignment position to the clearance position.

In accordance with one aspect of the disclosure, a system is disclosed for aligning at least one injector body to be installed into an engine component along a first direction. The alignment apparatus includes a first alignment member configured to swing between an alignment position and a clearance position, wherein the first alignment member is configured to align the at least one injector body along a second direction when in the alignment position. The apparatus further includes a second alignment member configured to align the at least one injector body along a third direction that is different from the second direction by contacting the at least one injector body via first and second contacting portions.

In accordance with one aspect of the disclosure, a method of aligning least one injector body to be installed into an engine component along a first direction is disclosed. The method comprises aligning the at least one injector body along a second direction by moving a first alignment member from a clearance position to an alignment position, wherein the first alignment member is configured to align the at least one injector body along a second direction. The method further comprises aligning the at least one injector body along a third direction via a second alignment member configured to align the at least one injector body along the third direction by contacting the at least one injector body via first and second contacting portions. The at least one injector body is contacted via the first and second contacting portions while the first alignment member is in the alignment position, and contact is maintained with the at least one injector via the first and second contacting portions while the first alignment is moved from the alignment position to the clearance position.

Additional advantages and novel features of these aspects will be set forth in part in the description that follows, and in part will become more apparent to those skilled in the art upon examination of the following or upon learning by practice of the disclosure.

BRIEF DESCRIPTION OF THE DRAWINGS

The novel features believed to be characteristic of aspects of the disclosure are set forth in the appended claims. In the description that follows, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objects and advantages thereof, will be best understood by reference to the following detailed description of illustrative aspects of the disclosure when read in conjunction with the accompanying drawings, wherein:

DETAILED DESCRIPTION

The disclosure relates to an injector alignment apparatus, system, and method. The injector alignment apparatus and system shown in FIGS. 1-14 may include similar components, however, various differences may be noted throughout the disclosure. The figures and corresponding description are intended to show various examples that may be used separately or in combination.

As an overview of one example implementation of the current disclosure, an injector alignment apparatus is shown for installing a series of three injectors. While throughout the disclosure three injectors are shown, it is noted that the current disclosure is applicable to any suitable number of injectors or similar configurations. For example, the injector alignment apparatus of the current disclosure is usable with a series of three injectors connected to a fuel rail.

One example implementation of the current disclosure is usable with injectors that are formed at least partially as a cylindrical body having a rubber boot disposed thereabout. During installation into an engine component, each injector may be aligned with relation to an injector receiving portion of an internal combustion engine component. In one example, each injector may be installed into the receiving portions of the engine component along at least a Z-direction. In order to properly align each injector prior to and during installation along the at least a Z-direction, the fuel rail, to which each injector is connected may be held stationary along the X-direction and Y-direction with relation to the engine component, for example. Due to variances in the location of each injector with relation to the fuel rail, further adjustment of the position of each injector with respect to the fuel rail and/or engine component may be necessary to ensure that each injector is properly installed and/or that no damage occurs to the injectors when installed into the receiving portions of the engine component. Accordingly the alignment apparatus of the current disclosure may be useable to properly align each injector along at least an X-direction and a Y-direction prior to and while installing the injectors into the engine component. Thus, after the injectors are properly aligned and held stationary in the X and Y directions, each injector may be installed into the engine block along the at least Z-direction. Further, to prevent contact between the alignment apparatus during the aforementioned installation, at least one first alignment component of the alignment apparatus may be moveable from an alignment position, for aligning each injector, to a clearance position, which provides clearance between the at least one first alignment component and the engine component during installation. A second alignment component may be configured to align and grasp each property aligned injector during installation along the at least a Z-direction.

Figure 1:
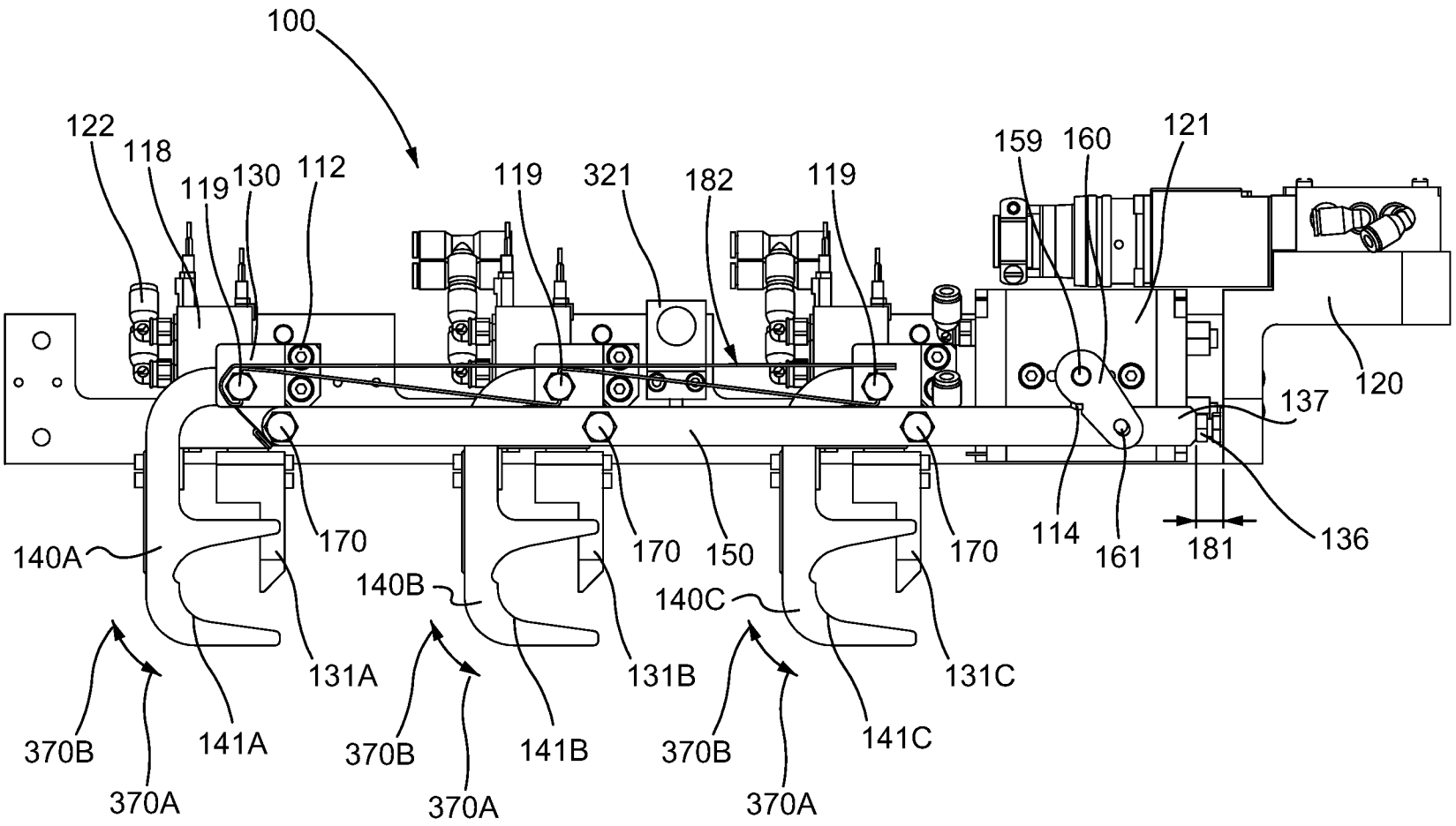
FIG. 1 is a bottom view of an injector alignment apparatus in accordance with an aspect of the disclosure.
Figure 2:
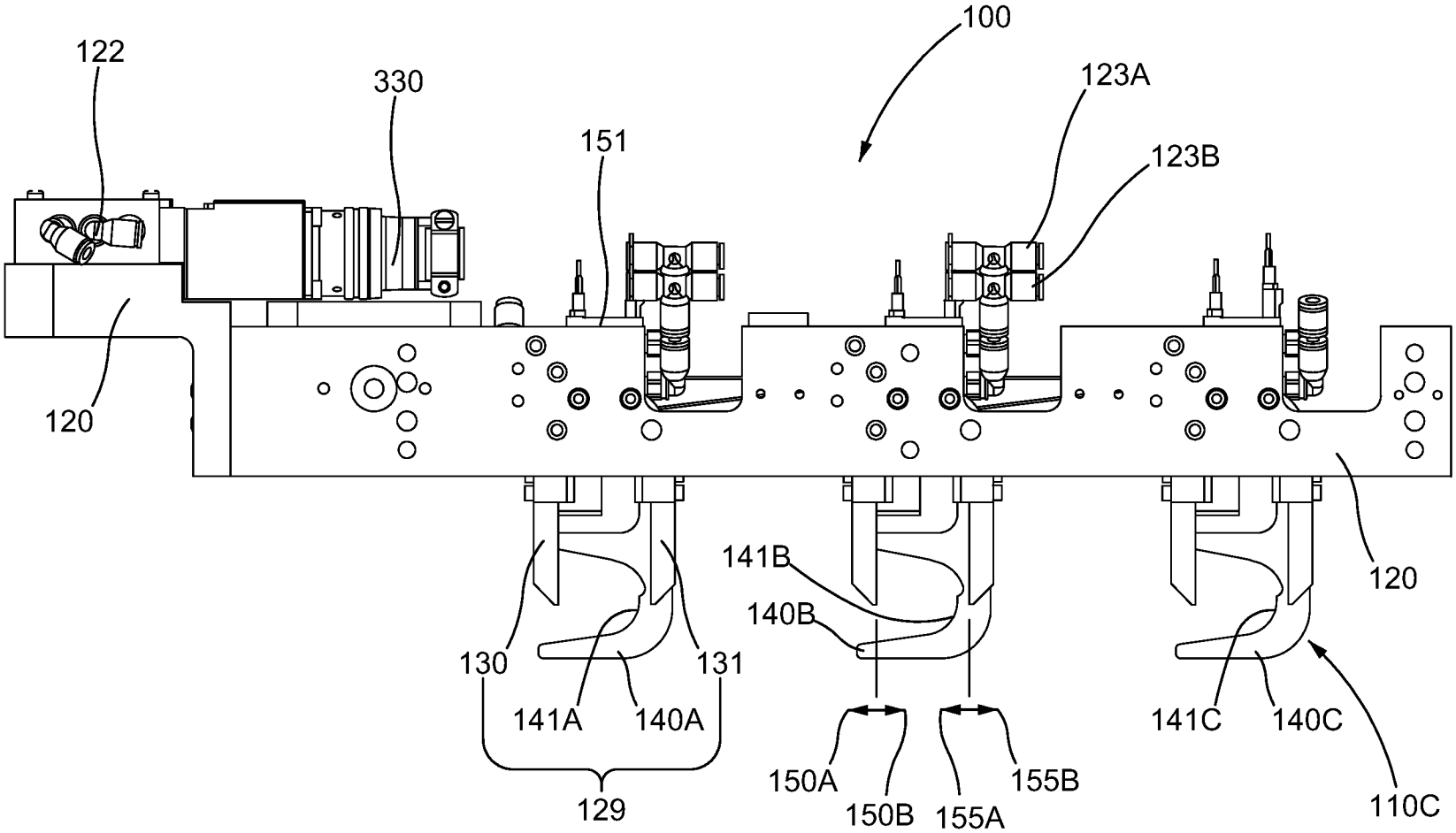
FIG. 2 is a top view of the injector alignment apparatus shown in FIG. 1 in accordance with an aspect of the disclosure.

FIG. 1 shows a bottom view of one example implementation of an alignment apparatus 100 in accordance with one aspect of the disclosure. The alignment apparatus 100 may include a clamp mount bar 120. The alignment apparatus 100 may further include a series of first alignment members 140A-C such as arms having partially C-shaped sections for encompassing a part to be aligned, such as an injector. The first alignment members 140A-C may include curved surfaces 141A-C, respectively, configured to receive a cylindrical surface of each respective injector body 300A-C (FIGS. 5-10). Each of the first alignment members 140A-C may be rotatably mounted with relation to the clamp mount bar 120 via a first pivotable connection at a first pivot portion 119. Thus, each first alignment member 140A-C may be swingably mounted to the clamp mount bar 120. In one example, the first pivot portion 119 of each first alignment member 140A-C may be a hole or other opening for receiving a pivot pin or bolt. Each of the first alignment members 140A-C may also be rotatably connected to a linkage 150 via a second pivotable portion 170. The linkage 150 may be rotatably connected to a swing arm 160 via a swing arm pivot 161. The swing arm 160 may be mounted to a rotary actuator 121 via a rotating mounting portion 159. The rotary actuator 121 may be a pneumatically, hydraulically, and/or an electrically driven actuator capable of providing rotational force to the swing arm 160 via the rotating mounting portion 159. In one example, the rotary actuator may be pneumatic and configured to receive a fluid source (e.g., air) from one or a series of fluid conduits 122 (FIG. 2). The alignment apparatus may further include a retract position confirmation sensor 321 configured to detect the position of at least one of the linkage 150, swing arm 160, swing arm pivot 161, any one of the first pivot portions 119, any one of the second pivotable portions 170, any one of the first alignment members 140, or any one of the second alignment members 129. The alignment apparatus may further include one or more electrical connectors 330, for connecting at least one sensor/detector, linear actuator, rotary actuator, or any other electrical component to any one of or a combination of Programmable Logic Controllers (PLC), a Programmable Logic Relays (PLR), Programmable Controllers, Distributed Control Systems (DCS), and other automation controllers, or the systems described below with reference to FIGS. 12-14

During operation of the alignment apparatus, rotation of the rotating mounting portion 159 causes each of the first alignment members 140A-C to rotate in directions 370B and/or 370A from a clearance position to an alignment position shown in FIG. 1, for example. An end portion 137 of the linkage 150 may contact a stopper portion 136 when the alignment position of each of the first alignment members 140A-C is reached. The stopper portion 136 may be threaded or otherwise linearly adjustable to allow for adjustment of a distance 181 between the clamp mount bar 120 and the end portion 137 of the linkage 150. Adjusting distance 181 may be selectively varied to allow for adjustment of the alignment position of each first alignment members 140A-C.

Figure 3:
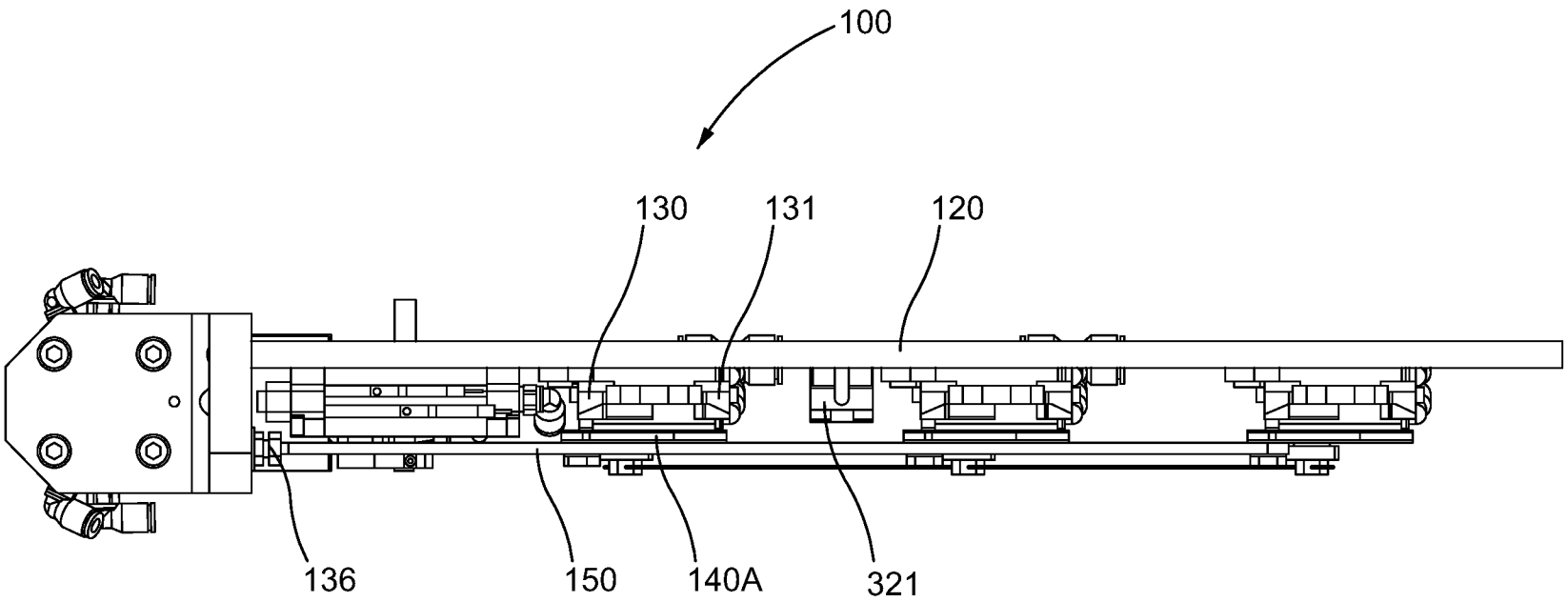
FIG. 3 is a side view of the injector alignment apparatus shown in FIGS. 1 and 2 in accordance with an aspect of the disclosure.

FIGS. 2 and 3 show an example top view and side view, respectively, of the alignment apparatus shown in FIG. 1. The alignment apparatus may further include a series of second alignment members 129, as shown in FIG. 2. Each one of the series of second alignment members 129 may be one or more arms each having a flat contact surface for moveably aligning a component, such as an injector. As mentioned above, each of the second alignment members 129 may further include a first and second arms 130 and 131, respectively. Further, each of the first and second arms 130 and 131 of the second alignment members 129 may be operatively connected to a linear actuator and/or gripper 151. The linear actuator and/or gripper 151 may be pneumatically, hydraulically, and/or electrically operated and configured to selectively translate the first contacting member 130 and the second contacting member 131 in inward directions 150B and 155A, respectively, and outward directions 150A and 155B, respectively, for example. In one example, the linear actuator and/or gripper 151 may be configured to move inward and outward via movement of the first and second arms 130, 131 in response a pressurized air source provided for such movement via connectors 123A and 123B. Further, a distance between the first and second contacting member 130 and 131 in the inward most position and outward most position may be selectively variable to accommodate injector having varying diameters, for example.

Figure 4:
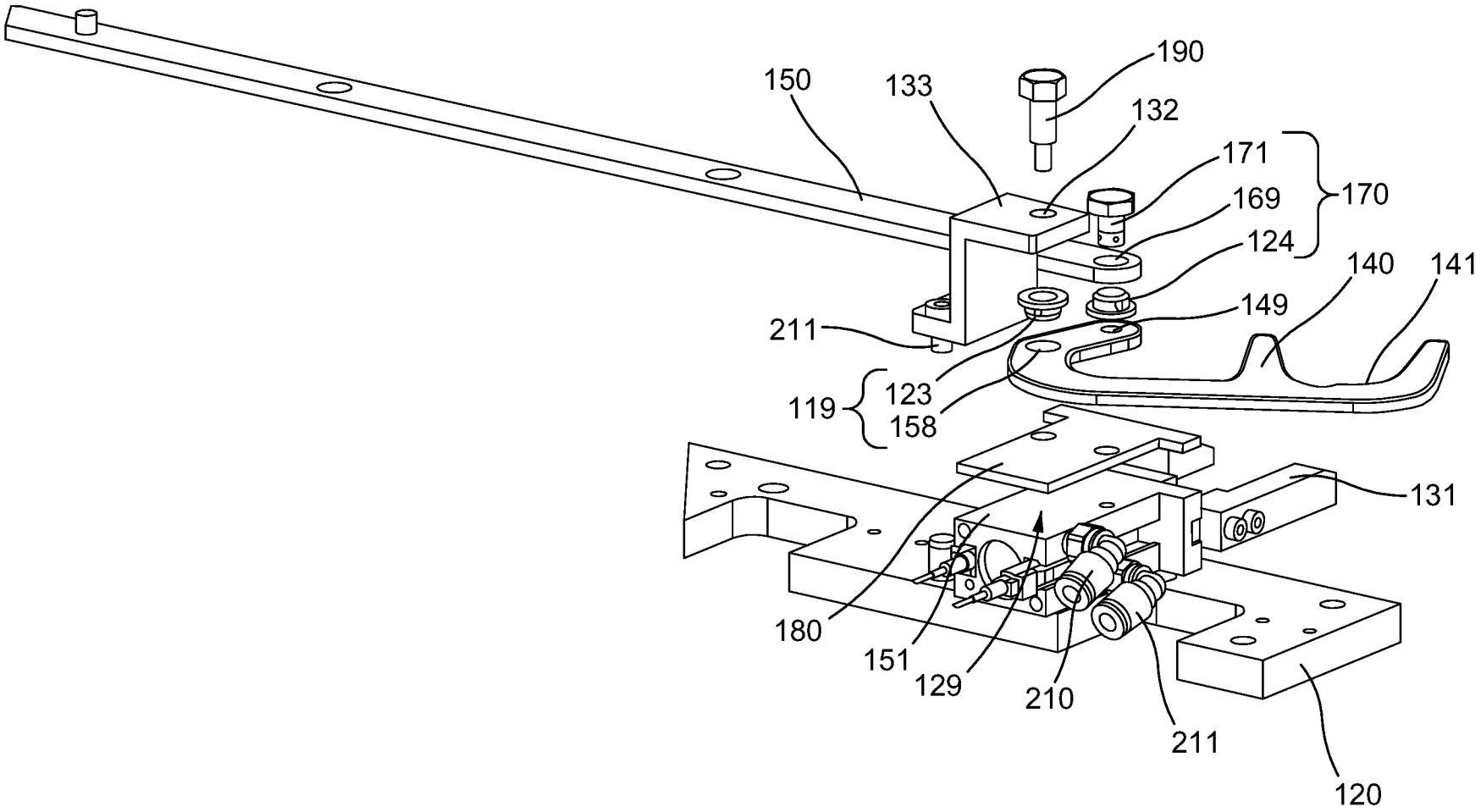
FIG. 4 is a partial perspective exploded view of the injector alignment apparatus shown in FIGS. 1-3 in accordance with an aspect of the disclosure.

FIG. 4 is an partial exploded view of the alignment apparatus shown in FIGS. 1-3. As shown in FIG. 4, the actuator and/or gripper 151 of each second alignment member 129 may be connectable to the clamp mount bar 120. Each actuator and/or gripper 151 may further include a wear plate 180 mountable to the linear actuator and/or gripper 151 for protecting the surface of the linear actuator and/or gripper 151 from wear associated with contact with the first alignment member 140 during alignment related operation thereof. A second pivotable portion 170 of the first alignment member 140 may be or include a rotational connector consisting of a bushing 124 receivable within a hole 169 in the linkage 150, for example. The bushing 124, may be configured to receive a pin and/or screw 171, that threadably or otherwise threads into or otherwise engages with a hole or opening 149 on the first alignment member 140. In addition, the first pivot portion 119 of the first alignment member 140 may be or include a rotational connection consisting of a bushing 123 receivable within a hole or opening 158 in the first alignment member 140. The bushing 123 may, for example, be configured to receive a pin and/or screw 190 that may be threadable into or otherwise engageable with hole or opening 158 for rotatational mounting of the first alignment member 140 relative to support block 133 via a hole or opening 132 in a support block 133. Upon assembly, the support block 133 may for example be mounted to the clamp mount bar 120 (e.g., via pin or other engagement feature 211).

Figure 5:
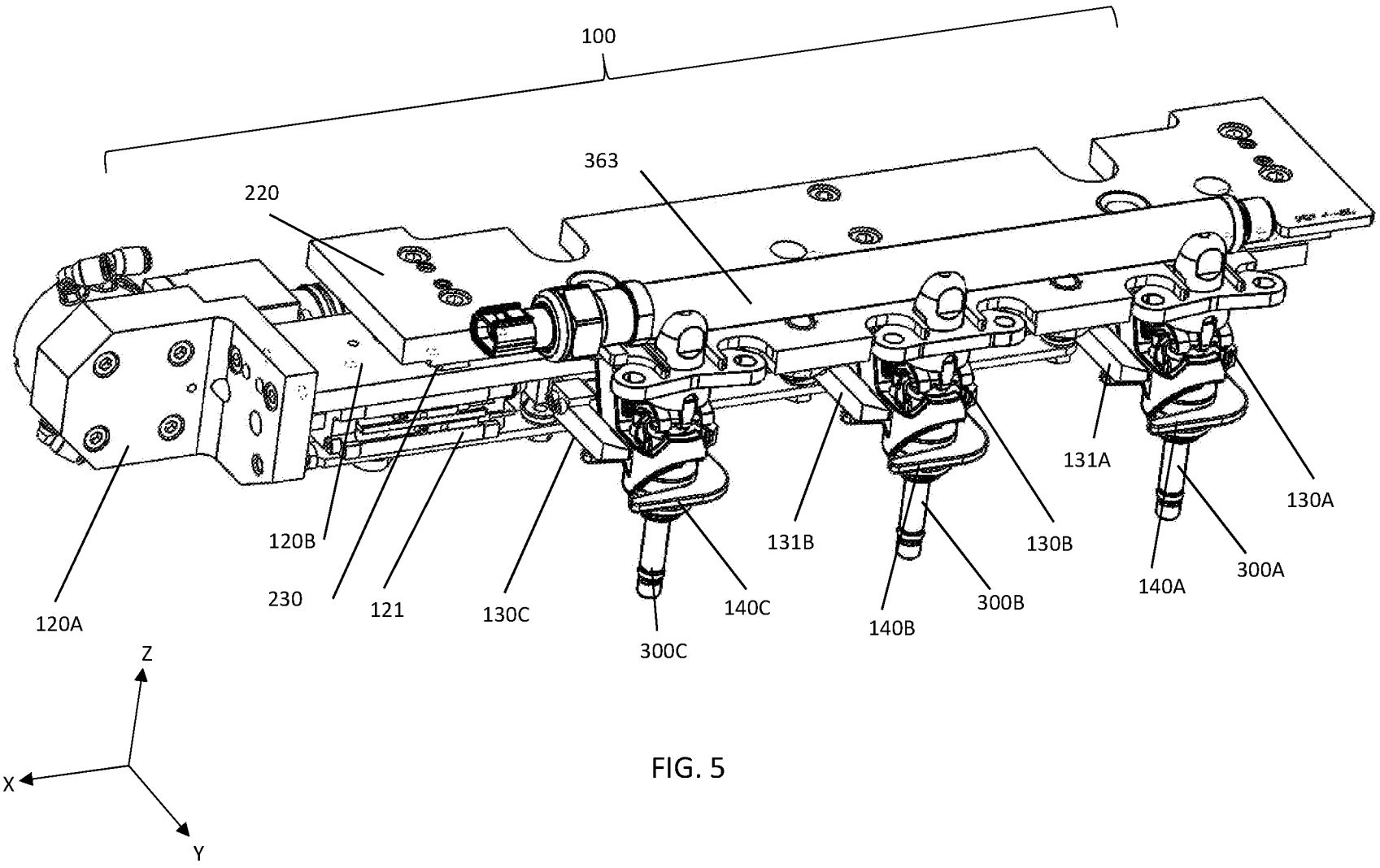
FIG. 5 is a top perspective view of the injector alignment apparatus shown in FIGS. 1-4 in accordance with an aspect of the disclosure.
Figure 6:
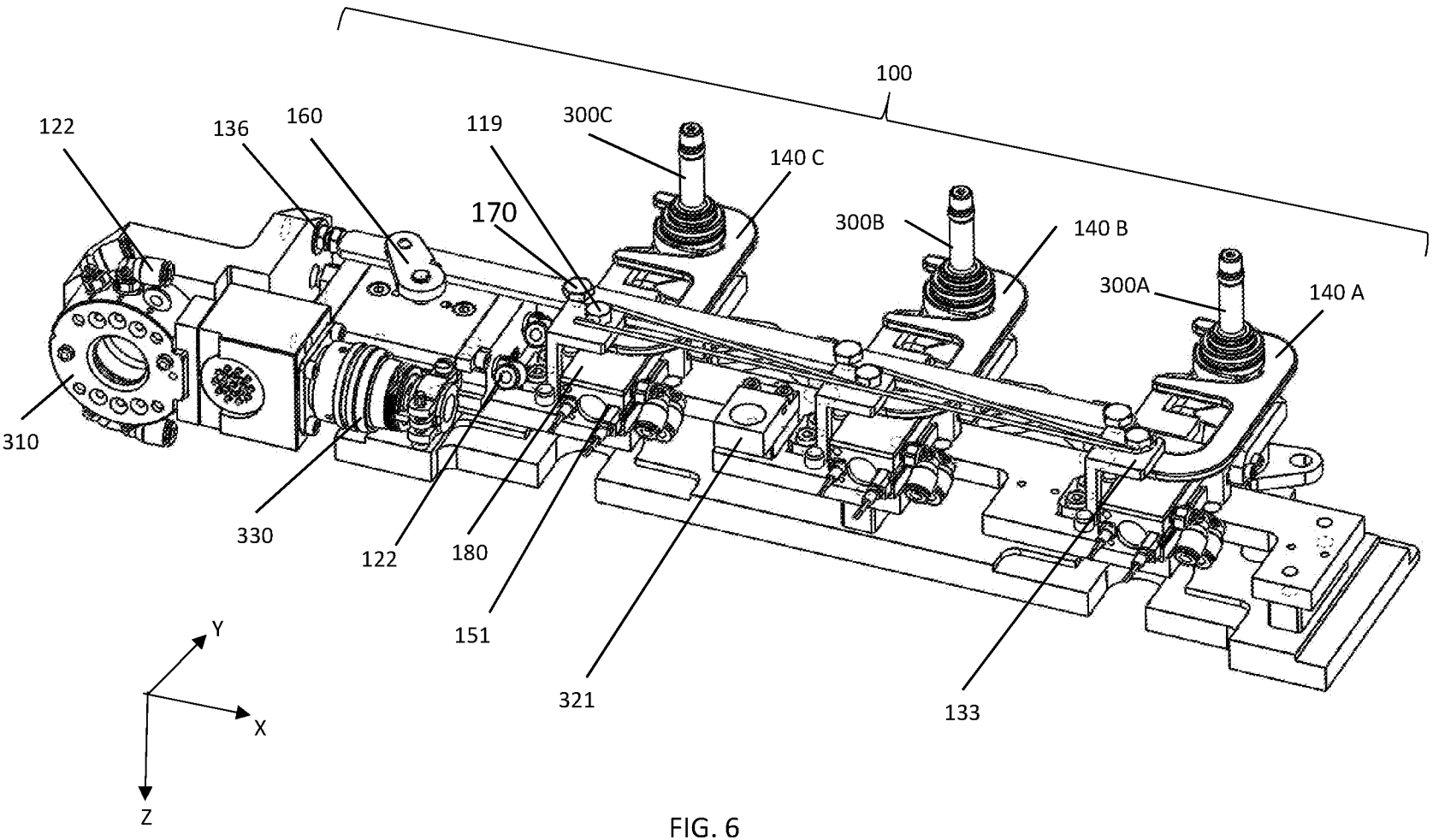
FIG. 6 is a bottom perspective view of the injector alignment apparatus shown in FIGS. 1-5 in accordance with one aspect of the disclosure.

FIGS. 5 and 6 are top perspective and bottom perspective views, respectively, of the injector apparatus shown in FIGS. 1-4. As shown in FIGS. 5 and 6, injectors 300A-C, which may be connected to a fuel rail 363 may be provided to and/or placed into the alignment apparatus 100. In one example, each of the injectors 300A-C may be flexibly and/or movably connected to fuel rail 363; thus allowing each of the injectors to be re-positioned with respect to one another. As described in further detail below with reference to FIGS. 7-10, the injectors 300A-C and/or fuel rail 363 may be provided to and/or placed into the alignment apparatus while each of the first alignment members 140A-C are in a clearance position and each of contacting portions 131A-C and 130A-C are in a non-contact position wherein each of the contacting portions 131A-C and 130A-C are spaced from a surface of the injectors 300A-C.

FIGS. 5 and 6 show one example of the alignment apparatus 100 with the first alignment members 140A-C and the first and second contacting members 130A-C and 131A-C of the second alignment members in an injector contact position. As described in further detail below, each of the first alignment members 140A-C and the first and second contacting members 130A-C and 131A-C of the second alignment members are movable from a injector contact and/or alignment position to a clearance position.

FIGS. 7-10 show various positions for example operation of the alignment apparatus of FIGS. 1-6. While not shown in the figures, the alignment apparatus 100 may be held stable in a fixed relation with or operatively connected to an engine component into which a series of injectors are to be installed. In one example the alignment apparatus 100 may be held stable and/or fixed with relation to the engine in the X and Y-direction shown in FIGS. 5-10. Further, the alignment apparatus 100 and/or the engine component may be movable at least in a Z-direction, with relation to the engine component, as referenced in FIGS. 5-10 allowing each of the injectors to be installed into the engine component once the injectors 300A-C are aligned as described below. Any known method may be used to control movement of the engine component and/or the alignment apparatus 100 with relation to one another during the injector installation process. For example, the engine component and/or alignment apparatus 100 may be connected to robot, Computer Numerical Control ("CNC") Gantry, CNC robot arm, a linear actuator, and/or any other mechanism that may provide at least one degree of movement between the engine component and/or the alignment apparatus 100. Any of the aforementioned systems may be controlled using an open loop system and/or closed loop system and may be implemented using any of the systems described with relation to FIGS. 12-14 below.

Figure 7:
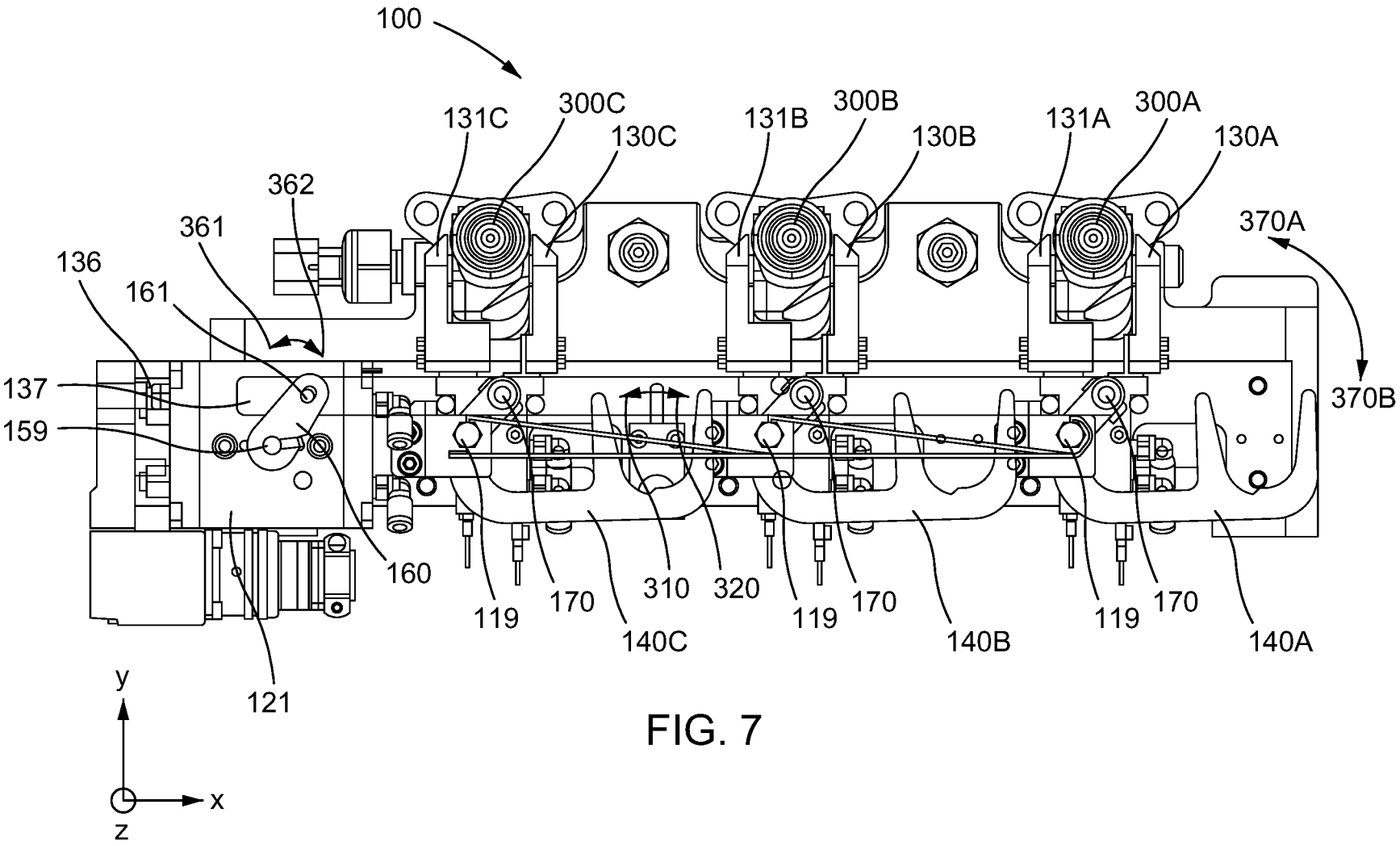
FIG. 7 is a bottom view of the injector alignment apparatus shown in FIGS. 1-6 in accordance with an aspect of the disclosure.

As shown in FIG. 7, the injectors 300A-C, which may be connected to a fuel rail may be provided to and/or placed into the alignment apparatus 100 while each of the first alignment members 140A-C are in a clearance position. In addition, each of contacting portions 131A-C and 130A-C may be in a non-contact position wherein each of the contacting portions 131A-C and 130A-C are spaced from a surface of the injectors 300A-C.

Figure 8:
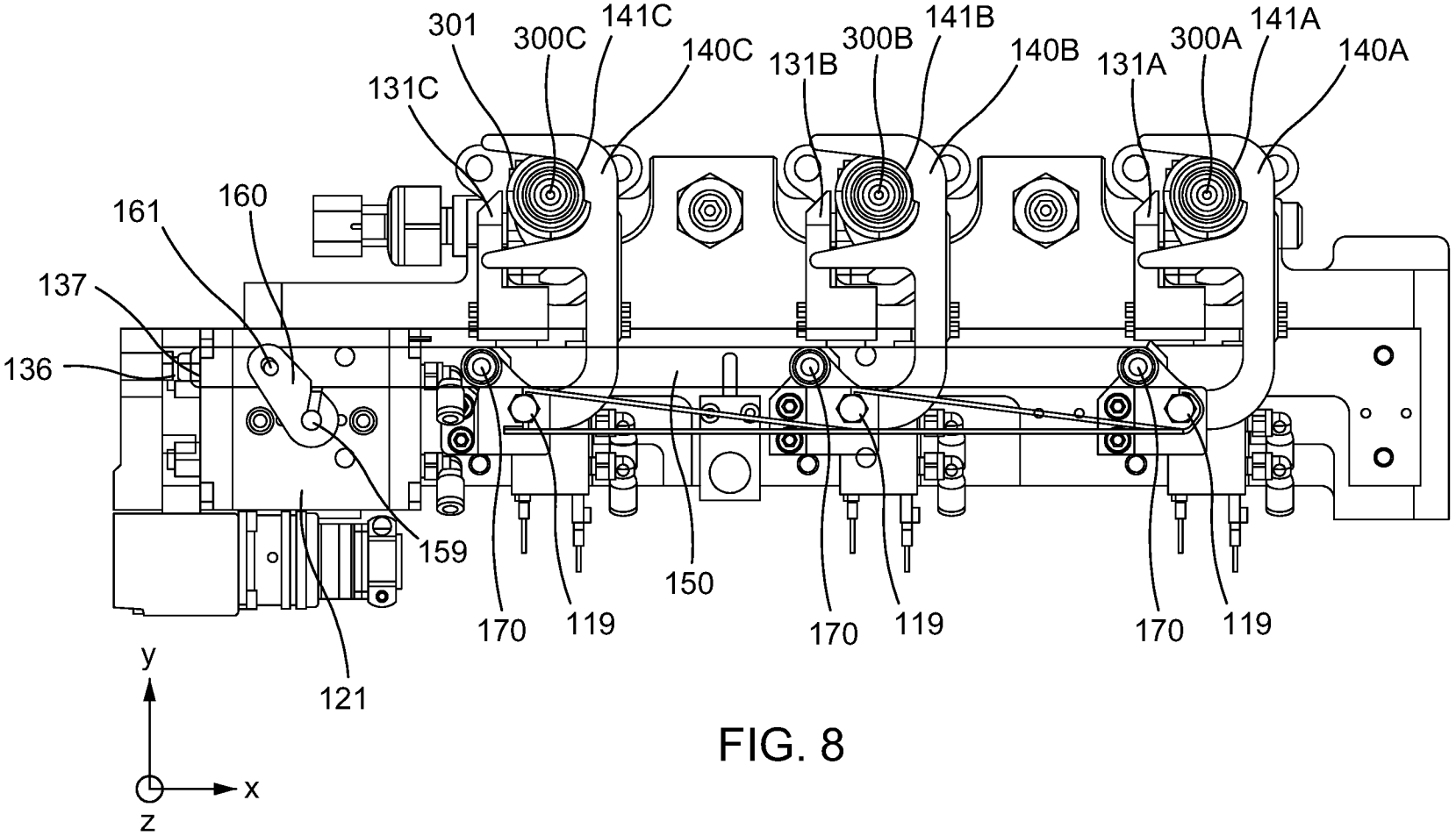
FIG. 8 is a bottom view of the injector alignment apparatus shown in FIGS. 1-7 in accordance with an aspect of the disclosure.

FIG. 8 shows one example of the first alignment members 140A-C in an alignment position. To arrive at the alignment position, the first alignment members 140A-C may be swung in direction 370A (FIG. 7) about the first pivot portion 119, thereby causing curved surfaces 141A-C to contact each injectors 300A-C respectively. Contact between the curved surfaces 141A-C of the first alignment members 140A-C and the outer curved surface of each injector 300A-C during and/or after each first alignment member swings into the alignment position as shown in FIG. 8 may cause each injector 300A-C to move into alignment position in at least the Y-direction as referenced in the axis shown in FIGS. 5-10. As shown in FIG. 8, the first and second contact portions and/or arms 130A-C and 131A-C of the second alignment member(s) 129 (FIG. 2) may be spaced in pairs from the surface of each of the injectors 300A-C so that the second alignment members 129 (FIG. 2) do not interfere with the alignment of the injectors as a result of movement in direction 370A by the first alignment members 140A-C.

As further shown in FIG. 8, each of the first alignment members 140A-C may be swung to an alignment position via movement of the link 150 in direction 310 (FIG. 7). The link 150 may be moved in direction 310 via the rotation of swing arm 160 in direction 361 (FIG. 7) through operation of the rotary actuator 121, for example, via rotating mounting portion 159. As link 150 moves in direction 310, an end portion 137 of the link 150 may contact an adjustable stopper portion 136, thereby limiting the rotation of each of the first alignment members 140A-C in direction 370A to the final alignment position shown in FIG. 8.

Once each of the first alignment members 140A-C is rotated to the alignment position so as to be in contact with each of the of the injectors 300A-C as shown in FIG. 8, the first and second contacting members 130A-C and 131A-C of the second alignment members 129 (FIG. 2) contact and grip each respective injector 300A-C. Contact between each of the first and second arms 130A-C and 131A-C and each corresponding injector 300A-C may also cause each injector 300A-C to be aligned in at least the X-direction. Thus, contact between the first alignment members 140A-C and each of the injectors 300A-C and the first and second contacting member 130A-C and 131A-C of the second alignment members 129 (FIG. 2) may cause the injectors 300A-C to be aligned with respect to the X-direction and Y-direction as referenced in the axis shown in FIGS. 5-10.

Figure 9:
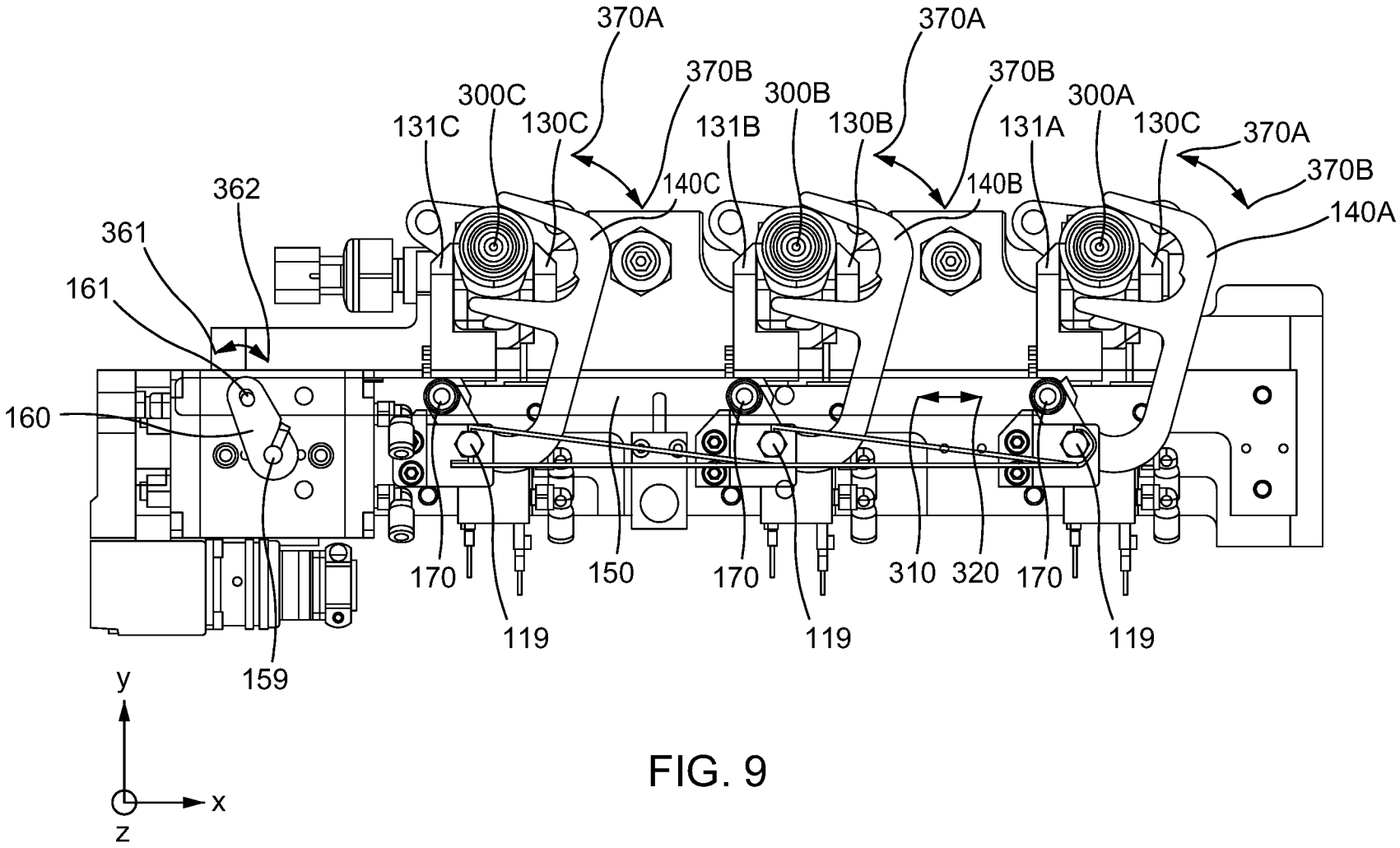
FIG. 9 is a bottom view of the injector alignment apparatus shown in FIGS. 1-8 in accordance with an aspect of the disclosure.
Figure 10:
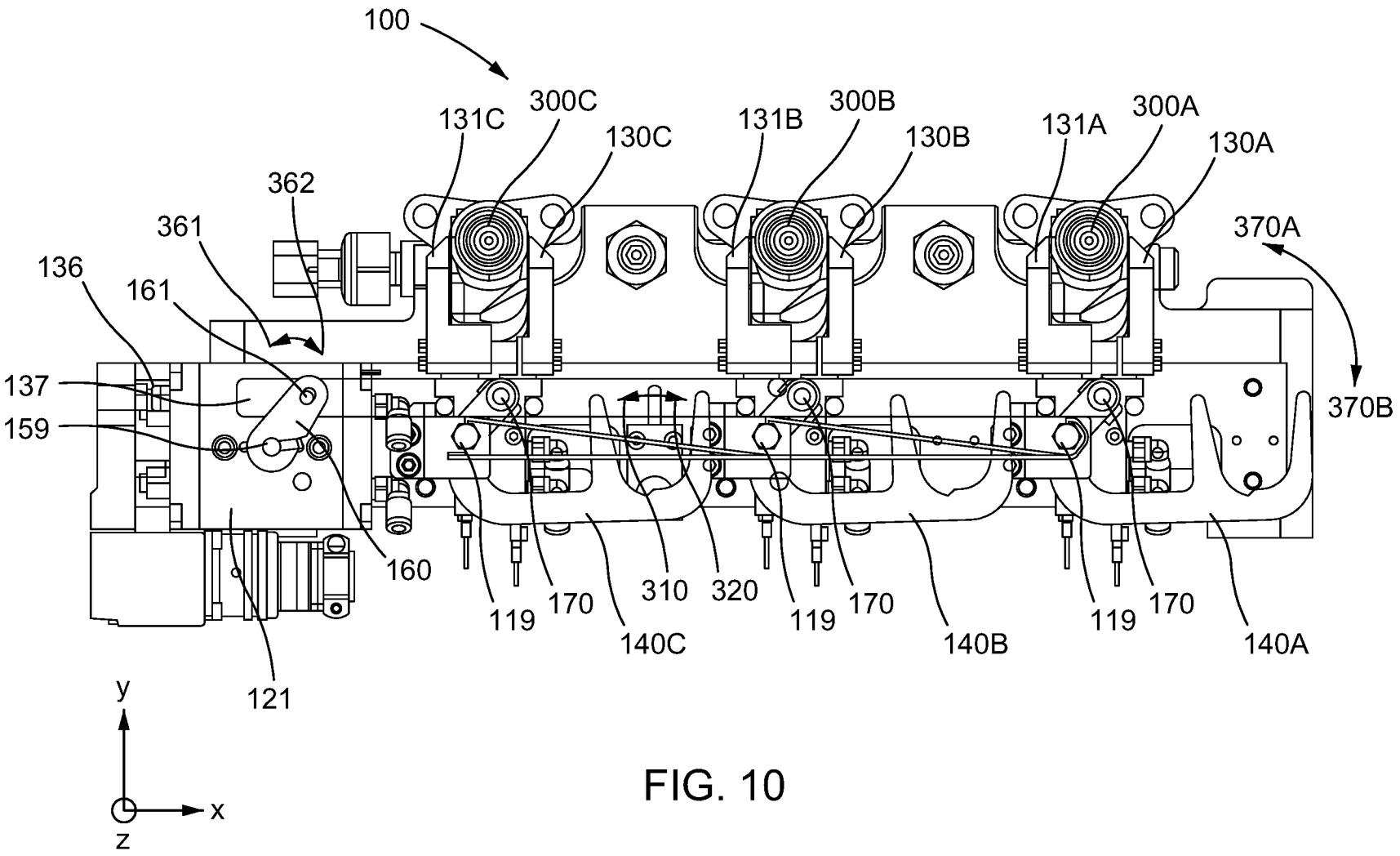
FIG. 10 is a bottom view of the injector alignment apparatus shown in FIGS. 1-9.

FIG. 9 shows another position of the alignment apparatus during the course of operation thereof. As shown in FIG. 9, the first and second contacting member 130 and 131 of the second alignment members 129 (FIG. 2) are at a position contacting and gripping each respective injector 300A-C, where such position may also correspond to the rotational position of the swing arm 160 via operation of the rotary actuator 121 in direction 362, for example. This rotational motion of the arm 160 in direction 362 may cause the link 150 to move in direction 320. Movement of the link 150 in direction 320 may cause each of the first alignment members 140A-C to rotate from an alignment position to a clearance position in direction 370B. As shown in FIG. 10, the swing arm 160 of the rotary actuator 121 may continue to rotate in direction 362 causing the link 150 to move in direction 320. Movement of the link 150 in direction 320 may cause each of the first alignment members 140A-C to continue to move toward the clearance position shown in FIG. 10.

In one example, the clearance position of each of the first alignment members 140A-C shown in FIG. 10 may be a position that allows for the injectors to be installed into an engine component along at least or partially in the Z-direction with minimal potential interference with the engine component or other components, as referenced in the axis shown in FIGS. 5-10. For example, the clearance position of the first alignment members 140A-C shown in FIG. 10 may prevent contact between at least one of the first alignment members 140A-C and one or more engine components when the injectors 300A-C are installed along the aforementioned at least Z-direction. Thus, the disclosed apparatus may be useful in repeatedly and precisely aligning an injector or multiple injectors with respect to a component into which the injectors are to be installed (e.g., an engine block or an intake manifold).

Figure 11:
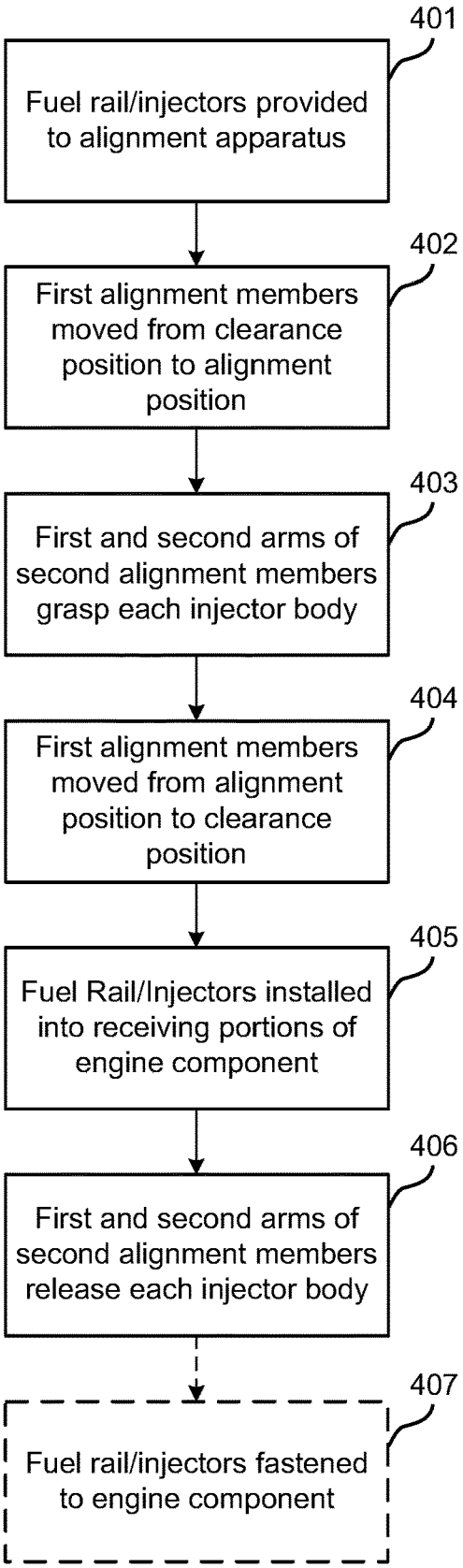
FIG. 11 is a flow chart showing one method of operation in accordance with an aspect of the disclosure.

FIG. 11, shows a flow chart of one example operation of a device in accordance with aspects of the current disclosure. During installation of the injectors into an engine component, a fuel rail and series of injectors, which may interchangeably be referred to as an injector assembly, may be provided to alignment apparatus 100. One example of a series of injectors 300A-C are shown and described with reference to FIGS. 5-10. Once the injector assembly is provided to the alignment apparatus in step 401, the first alignment members are moved from a clearance position to an alignment position at step 402. One example of the operation in step 402 is shown and described with reference to FIGS. 7 and 8 above. Once the first alignment members are moved to an alignment position at step 402, the first and second arms of the second alignment members align and grasp each injector body at step 403. For example, step 403 may occur between the operations described with respect to FIGS. 6 and 7 described above. In step 404, the first alignment members may be moved from an alignment position to a clearance position while the second alignment members remain grasp and remain in contact with the injectors. One example of the operation of step 404 is described with reference to FIGS. 9 and 10 above. Once the first alignment members are moved to a clearance position in step 404, the injector assembly may be installed into a receiving portion of the engine component in step 405. Referencing FIG. 10 as an example, in step 405 each of the injectors 300A-C may be aligned with relation to the X and Y-directions. Once injectors 300A-C are aligned with respect to the engine component, the injectors may be installed along at least a Z-direction, with respect to the receiving portions of the engine component as referenced in FIG. 10, for example. Once each injector is installed in step 405, the second alignment members may be controlled to release each injector body in step 406. In some aspects, the fuel rail assembly and/or injectors may be fastened to the engine component in step 407.

Any one of the aforementioned functions of the injector alignment apparatus may be automatically and/or manually operated by and include any one of or a combination of a Programmable Logic Controller (PLC), a Programmable Logic Relay (PLR), a Programmable Controller, a Distributed Control System (DCS), and other automation controllers. The aforementioned industrial controllers may store and execute user-defined parameters to effect decisions during a process. In addition user-defined parameters effecting decisions during a process may be remotely stored are described in further detail with respect to FIGS. 12-14 below. Industrial controllers may have various programming functions that may include ladder logic, structured text, function block diagramming, instruction lists, and sequential flow charts, for example. In one example, the aforementioned rotary actuator 121 (FIGS. 1-10) and/or the linear actuator and/or gripper(s) 150 may be electrically, pneumatically, and/or hydraulically controlled via a single or a plurality of industrial controllers. Each industrial controller may operate in accordance with a stored control program that causes the controller to examine the state of a single or multiple components of the injector alignment apparatus and/or any related components by evaluating signals from one or more sensing devices (e.g., switches, load cells, light sensors, and/or pressure sensors) based on a procedural framework and/or the sensor signals, for example.

Figure 12:
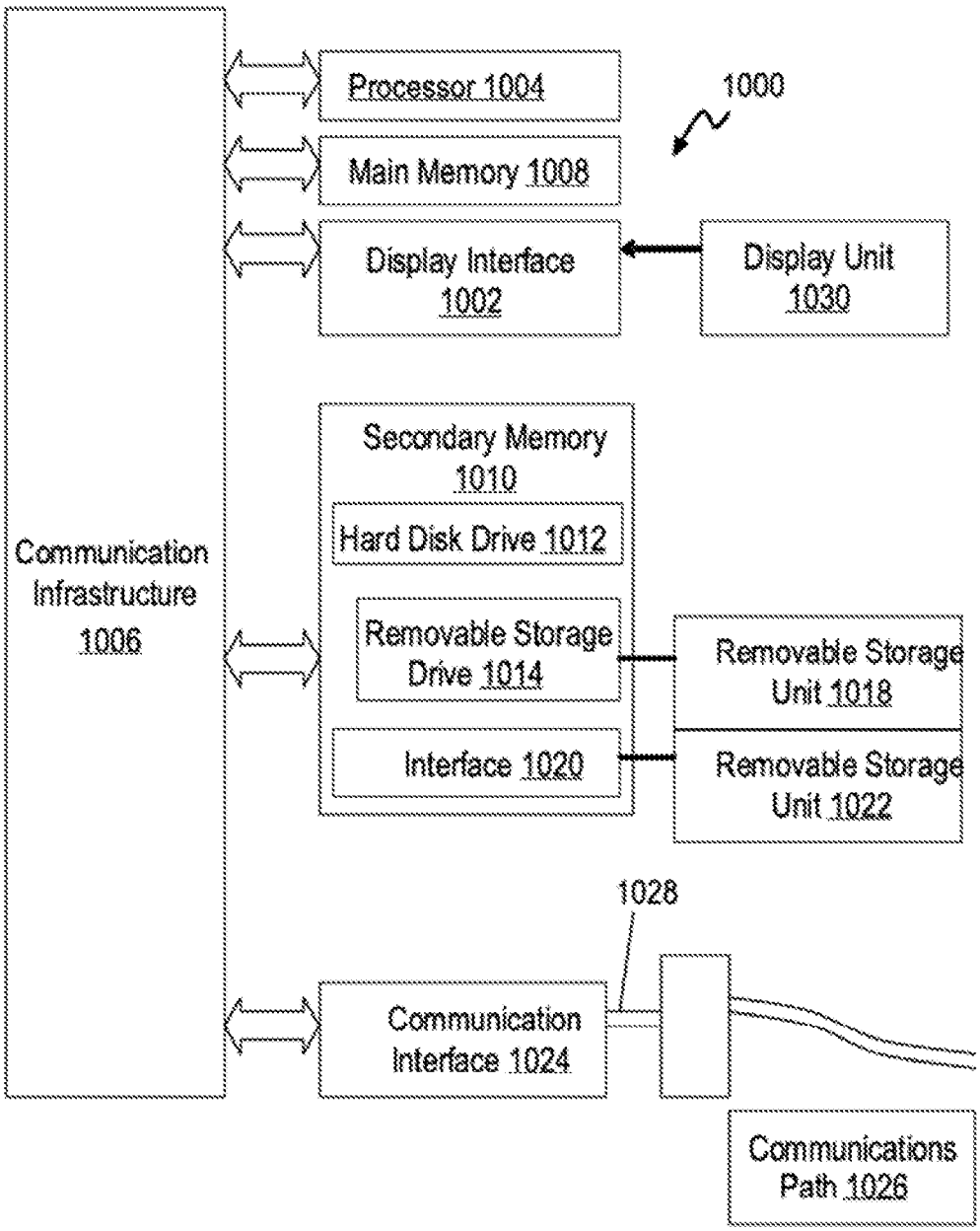
FIG. 12 is an example computer system for an electronic system in accordance with an aspect of the disclosure.

Further, various aspects of the abovementioned control of the injector alignment apparatus 100 and various system features shown and described in relation to FIGS. 1-11 may be implemented using hardware, software, or a combination thereof and may be implemented in one or more computer systems or other processing systems. In an aspect of the present disclosure, features are directed toward one or more computer systems capable of carrying out the functionality of the data processing disclosed above. An example of such a computer system 1000 is shown in FIG. 12.

Computer system 1000 includes one or more processors, such as processor 1004. The processor 1004 is connected to a communication infrastructure 1006 (e.g., a communications bus, cross-over bar, or network). Various software aspects are described in terms of this example computer system. After reading this description, it will become apparent to a person skilled in the relevant art(s) how to implement aspects of the invention using other computer systems and/or architectures.

Computer system 1000 may include a display interface 1002 that forwards graphics, text, and other data from the communication infrastructure 1006 (or from a frame buffer not shown) for display on a display unit 1030. Computer system 1000 also includes a main memory 1008, preferably random access memory (RAM), and may also include a secondary memory 1010. The secondary memory 1010 may include, for example, a hard disk drive 1012, and/or a removable storage drive 1014, representing a floppy disk drive, a magnetic tape drive, an optical disk drive, a universal serial bus (USB) flash drive, etc. The removable storage drive 1014 reads from and/or writes to a removable storage unit 1018 in a well-known manner. Removable storage unit 1018 represents a floppy disk, magnetic tape, optical disk, USB flash drive etc., that is read by and written to removable storage drive 1014. As will be appreciated, the removable storage unit 1018 includes a computer usable storage medium having stored therein computer software and/or data.

Alternative aspects of the present invention may include secondary memory 1010 and may include other similar devices for allowing computer programs or other instructions to be loaded into computer system 1000. Such devices may include, for example, a removable storage unit 1022 and an interface 1020. Examples of such may include a program cartridge and cartridge interface (such as that found in video game devices), a removable memory chip (such as an erasable programmable read only memory (EPROM), or programmable read only memory (PROM)) and associated socket, and other removable storage units 1022 and interfaces 1020, that allow software and data to be transferred from the removable storage unit 1022 to computer system 1000.

Computer system 1000 may also include a communications interface 1024. Communications interface 1024 allows software and data to be transferred between computer system 1000 and external devices. Examples of communications interface 1024 may include a modem, a network interface (such as an Ethernet card), a communications port, a Personal Computer Memory Card International Association (PCMCIA) slot and card, etc. Software and data transferred via communications interface 1024 are in the form of signals 1028, which may be electronic, electromagnetic, optical or other signals capable of being received by communications interface 1024. These signals 1028 are provided to communications interface 1024 via a communications path (e.g., channel) 1026. This path 1026 carries signals 1028 and may be implemented using wire or cable, fiber optics, a telephone line, a cellular link, a radio frequency (RF) link and/or other communications channels. In this document, the terms "computer program medium" and "computer usable medium" are used to refer generally to media such as a removable storage drive 1018, a hard disk installed in hard disk drive 1012, and signals 1028. These computer program products provide software to the computer system 1000. Aspects of the present invention are directed to such computer program products.

Computer programs (also referred to as computer control logic) are stored in main memory 1008 and/or secondary memory 1010. Computer programs may also be received via communications interface 1024. Such computer programs, when executed, enable the computer system 1000 to perform the features in accordance with aspects of the present invention, as discussed herein. In particular, the computer programs, when executed, enable the processor 1004 to perform the features in accordance with aspects of the present invention. Accordingly, such computer programs represent controllers of the computer system 1000.

In an aspect of the present invention where the invention is implemented using software, the software may be stored in a computer program product and loaded into computer system 1000 using removable storage drive 1014, hard drive 1012, or communications interface 1020. The control logic (software), when executed by the processor 1004, causes the processor 1004 to perform the functions described herein. In another aspect of the present invention, the system is implemented primarily in hardware using, for example, hardware components, such as application specific integrated circuits (ASICs).

Figure 13:
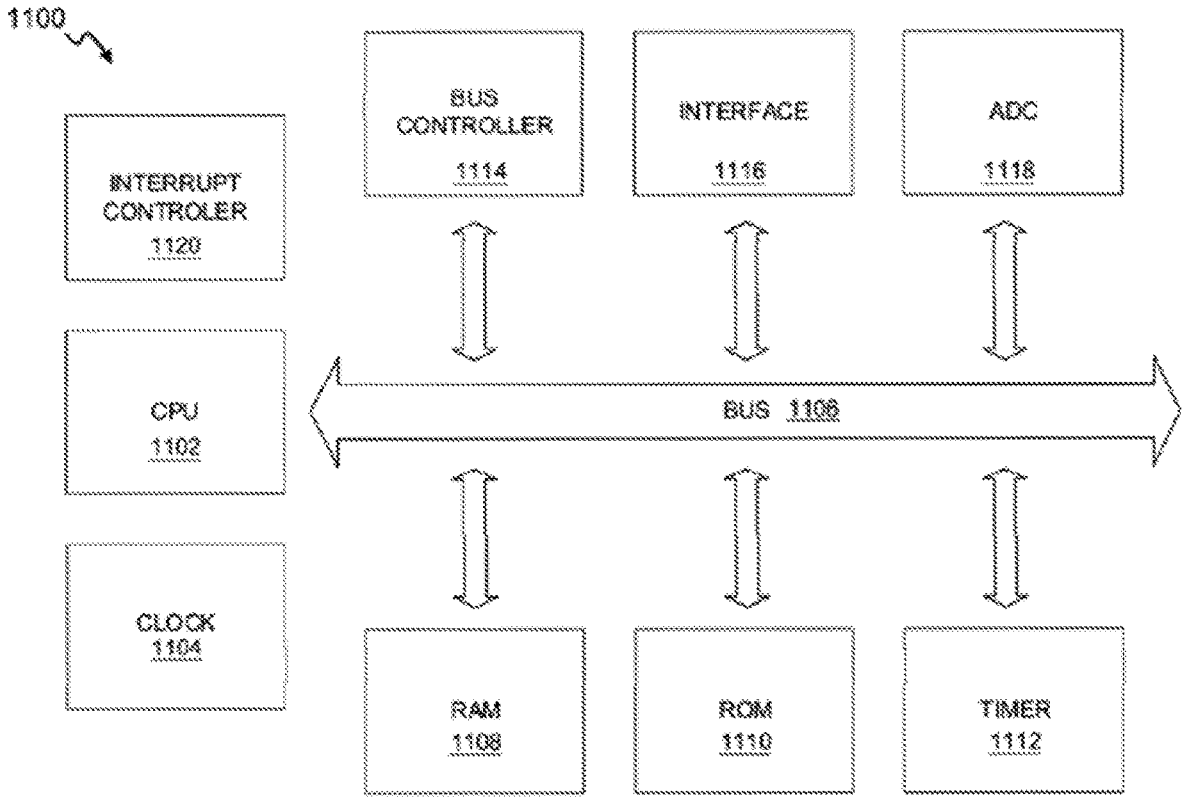
FIG. 13 is an example microcontroller in accordance with an aspect of the disclosure.

In some implementations, one or more microcontrollers may be implemented for carrying out certain features of the present disclosure, such as control features for controlling the alignment apparatus and system 100 of FIGS. 1-11. An example of such a microcontroller 1100 is shown in FIG. 13. The microcontroller 1100 includes a CPU 1102, RAM 1108, ROM 1110, a timer 1112, a BUS controller, an interface 1114, and an analog-to-digital converter (ADC) 1118 interconnected via an on board BUS 1106.

The CPU 1102 may be implemented as one or more single core or multi-core processors, and receive signals from an interrupt controller 1120 and a clock 1104. The clock 1104 sets the operating frequency of the entire microcontroller 1100 and may include one or more crystal oscillators having predetermined frequencies. Alternatively, the clock 1104 may receive an external clock signal. The interrupt controller 1120 may also send interrupt signals to the CPU to suspend CPU operations. The interrupt controller 1120 may transmit an interrupt signal to the CPU when an event requires immediate CPU attention.

The RAM 1108 may include one or more SRAM, DRAM, SDRAM, DDR SDRAM, DRRAM or other suitable volatile memory. The ROM 1110 may include one or more PROM, EPROM, EEPROM, flash memory, or other types of non-volatile memory.

The timer 1112 may keep time and/or calculate the amount of time between events occurring within the microcontroller 1100, count the number of events, and/or generate baud rate for communication transfer. The BUS controller 1114 prioritizes BUS usage within the microcontroller 1100. The ADC 1118 allows the microcontroller 1100 to send out pulses to signal other devices.

The interface 1116 is an input/output device that allows the microcontroller 1100 to exchange information with other devices. In some implementations, the interface 1116 may include one or more parallel port, a serial port, or other computer interfaces.

Figure 14:
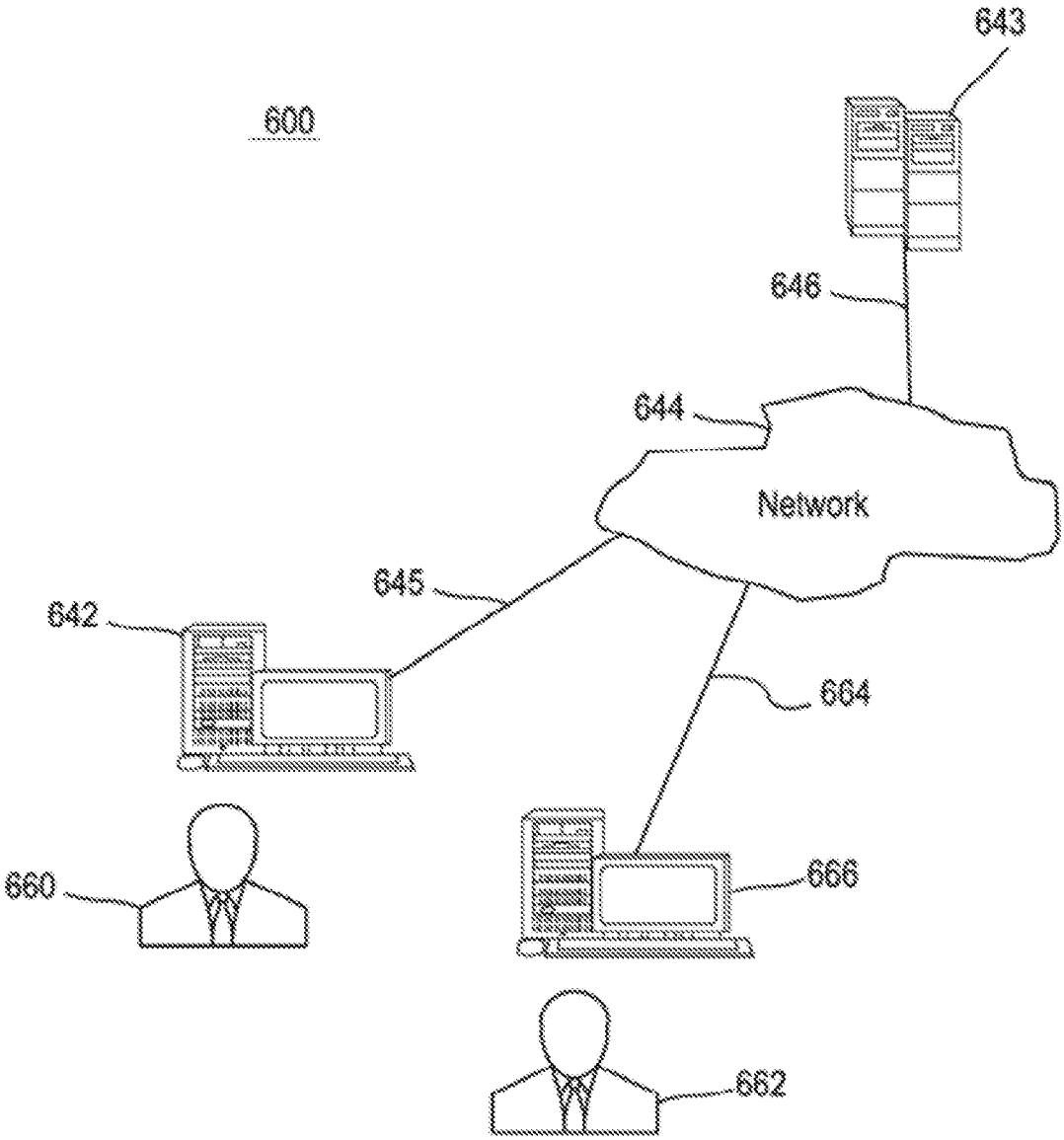
FIG. 14 is a block diagram of various example system components according to one aspect of the disclosure.

FIG. 14 is a block diagram of various example system components, in accordance with another example implementation of various features on a network. FIG. 14 shows various features of a communication system 600 usable in accordance with aspects described herein. The communication system 600 includes one or more accessors 660, 662 (also referred to interchangeably herein as one or more "users") and one or more terminals 642, 666. For example, terminals 642, 666 can include a control system for the alignment apparatus and/or controls systems shown in FIGS. 1-13 or by other users at other locations remote from the control system for and/or for the alignment apparatus and systems described with relation to FIGS. 1-13. In one aspect, data for use in accordance with aspects described herein is, for example, input and/or accessed by accessors 660, 662 via terminals 642, 666, such as industrial controllers, robots, personal computers (PCs), minicomputers, mainframe computers, microcomputers, telephonic devices, or wireless devices, such as personal digital assistants ("PDAs") or a hand-held wireless devices coupled to a server 643, such as a PC, minicomputer, mainframe computer, microcomputer, or other device having a processor and a repository for data and/or connection to a repository for data, via, for example, a network 644, such as the Internet or an intranet, and couplings 645, 646, 664. The couplings 645, 646, 664 include, for example, wired, wireless, or fiberoptic links. In another example variation, the method and system in accordance with aspects described herein operate in a stand-alone environment, such as on a single terminal.

The aspects discussed herein can also be described and implemented in the context of computer-readable storage medium storing computer-executable instructions. Computer-readable storage media includes computer storage media and communication media. For example, flash memory drives, digital versatile discs (DVDs), compact discs (CDs), floppy disks, and tape cassettes. Computer-readable storage media can include volatile and nonvolatile, removable and non-removable media implemented in any method or technology for storage of information such as computer readable instructions, data structures, modules or other data.

The foregoing description of various aspects and examples have been presented for purposes of illustration and description. It is not intended to be exhaustive nor to limit the disclosure to the forms described. The embodiment (s) illustrated in the figures can, in some instances, be understood to be shown to scale for illustrative purposes. Numerous modifications are possible in light of the above teachings, including a combination of the abovementioned aspects. Some of those modifications have been discussed and others will be understood by those skilled in the art. The various aspects were chosen and described in order to best illustrate the principles of the present disclosure and various aspects as are suited to the particular use contemplated. The scope of the present disclosure is, of course, not limited to the examples or aspects set forth herein, but can be employed in any number of applications and equivalent devices by those of ordinary skill in the art. Rather, it is hereby intended the scope be defined by the claims appended hereto.

KEY FOR DRAWINGS

Number Part Names

100 alignment apparatus
119 first pivot portion
120 clamp mount bar
121 rotary actuator
122 fluid conduits
123A-B connectors
123 bushing
124 bushing
129 second alignment member
130 first contacting member
131 second contacting member
132 opening
133 support block
136 adjustable stopper portion
137 end portion
140A-C first alignment member(s)
141A-C curved surface(s)
149 opening
150 link
151 gripper
159 rotating mounting portion
160 swing arm
161 swing arm pivot
169 hole
170 second pivotable portion
171 screw
180 plate
190 screw
211 engagement feature
300A-C Injector(s)
321 retract position confirmation sensor
363 fuel rail
330 electrical connector

What is claimed is:

1. An alignment apparatus for aligning at least one injector body to be installed into an engine component along a first direction, the alignment apparatus comprising:

a first alignment member configured to swing from a clearance position to an alignment position, wherein the first alignment member is configured to align the at least one injector body along a second direction when in the alignment position; and a second alignment member configured to align the at least one injector body along a third direction by contacting the at least one injector body via a first and second contacting portion, wherein the second alignment member is configured to contact the injector via the first and second contacting portion when the first alignment member is in the alignment position and the second alignment is configured to maintain contact with the at least one injector body while the first alignment member swings from the alignment position back to the clearance position, wherein the first alignment member is pivotally connected to the alignment apparatus at a first pivotable connection and to a driving link at a second pivotable connection, wherein a linear force provided by the driving link causes the first alignment member to swing from the alignment position to the clearance position.

2. The alignment apparatus of claim 1, wherein the first direction is different from the second direction and third direction.

3. The alignment apparatus of claim 1, wherein the first alignment member has a curved portion configured to contact a curved portion of the at least one injector body.

4. The alignment apparatus of claim 1, wherein the first alignment member contacts the at least one injector body in the alignment position and does not contact the at least one injector body in the clearance position.

5. The alignment apparatus of claim 1, wherein the first and second contacting portion are configured to grasp the at least one injector body while the first alignment member swings from the alignment position to the clearance position.

6. The alignment apparatus of claim 1, wherein the driving link is operatively connected to a rotary actuator, wherein the rotary actuator provides the linear force.

7. A system for aligning at least one injector body to be installed into an engine block along a first direction, the alignment system comprising:

a first alignment member pivotally connected to an alignment apparatus at a first pivotable connection and to a driving link at a second pivotable connection and configured to swing from a clearance position to an alignment position via a linear force provided by the driving link causing the first alignment member to swing from an alignment position to a clearance position, and wherein the first alignment member is configured to align the at least one injector body along a second direction when in the alignment position;

a second alignment member configured to align the at least one injector body along a third direction by contacting the at least one injector body via a first and second contacting portion.

8. The system of claim 7, wherein the second alignment member is configured to contact the injector via the first and second contacting portion while the first alignment member is in the alignment position and the second alignment member is configured to maintain contact with the at least one injector body while the first alignment member swings from the alignment position back to the clearance position.

9. The system of claim 7, wherein the second direction is substantially perpendicular to the third direction.

10. The system of claim 7, wherein the first alignment member has a curved portion configured to contact a curved portion of the at least one injector body.

11. The system of claim 8, wherein the first alignment member contacts the at least one injector body in the alignment position and does not contact the at least one injector body in the clearance position.

12. The system of claim 7, wherein the first and second contacting portion are configured to grasp the at least one injector body while the first alignment member swings from the alignment position to the clearance position.

13. The system of claim 7, wherein the driving link is operatively connected to a rotary actuator, wherein the rotary actuator provides the linear force.

14. A method of aligning least one injector body to be installed into an engine component along a first direction via an alignment apparatus, the method comprising:

aligning the at least on injector body along a second direction by moving a first alignment member from a clearance position to an alignment position, wherein the first alignment member is configured to align the at least one injector body along a second direction;

aligning the at least one injector body along a third direction via a second alignment member configured to align the at least one injector body along the third direction by contacting the at least one injector body via a first and second contacting portion;

contacting the at least one injector via the first and second contacting portion while the first alignment member is in the alignment position; and maintaining contact with the at least one injector via the first and second contacting portion while the first alignment member is moved from the alignment position to the clearance position, wherein the first alignment member is pivotally connected to the alignment apparatus at a first pivotable connection and to a driving link at a second pivotable connection, wherein a linear force provided by the driving link causes the first alignment member to swing from the alignment position to the clearance position.

15. The method of claim 14, wherein the first alignment member contacts the at least one injector body in the alignment position and does not contact the at least one injector body in the clearance position.

16. The method of claim 14, wherein the second direction is substantially perpendicular to the third direction.

17. The method of claim 14, wherein the first and second contacting portion grasp the at least on injector body while the first alignment member is moved from the alignment position to the clearance position.

* * * * *